United States Patent [19]

Morris, Jr.

[11] 4,336,581

[45] Jun. 22, 1982

[54] FOLLOW SPOT SIGHTING DEVICE

[76] Inventor: Albert W. Morris, Jr., 2700 Connecticut Ave., Washington, D.C. 20008

[21] Appl. No.: 150,161

[22] Filed: May 15, 1980

[51] Int. Cl.[3] ..... F21S 17/00; F21P 5/00

[52] U.S. Cl. ..... 362/457

[58] Field of Search ..... 33/250, 262, 263; 350/10; 356/153, 247, 251; 89/41 B; 362/110, 111, 112, 113, 114, 253, 457, 458, 285

[56] References Cited

U.S. PATENT DOCUMENTS

| | | | |
|---|---|---|---|
| 613,511 | 11/1898 | Haskin | 362/457 |
| 708,239 | 9/1902 | Lyon | 362/457 |
| 1,452,651 | 4/1923 | Norrlin | 362/110 |
| 1,512,705 | 10/1924 | Margaretten et al. | 362/253 |
| 2,076,913 | 4/1937 | Müller | 350/10 |
| 3,627,429 | 12/1971 | Jaenicke | 356/153 |
| 3,737,232 | 6/1973 | Milburn, Jr. | 350/10 |
| 3,739,167 | 6/1973 | Avery | 362/110 |
| 3,867,764 | 2/1975 | Dunmire et al. | 362/110 |
| 3,917,940 | 11/1975 | Duddy | 362/398 |
| 3,978,590 | 9/1976 | Wedding et al. | 33/263 |
| 4,228,489 | 10/1980 | Martin | 362/250 |

*Primary Examiner*—Charles T. Jordan
*Attorney, Agent, or Firm*—Kenneth E. Darnell

[57] ABSTRACT

A device primarily intended for positioning a follow spotlight in a theatrical setting to allow a performer or an object to be "picked up" on cue, the invention is mounted on the movable light barrel of a follow spotlight and thus is moved exactly with the spot as the operator aims the beam of light. The present sighting device includes a sighting arm having sight reticles disposed at each end, the sight reticles being held on the arm by retentive couplings which allow 360° rotation of the reticles about the arm. The medial portion of the sighting arm is mounted to the distal end of an L-shaped standard by a cruciform coupling which allows both rotation of the arm about the mounting locus and linear displacement of the arm relative to said coupling. The anterior end of the standard is removably attached to the follow spotlight by a preferably magnetic mount, the standard being capable of rotation about its longitudinal axis. The sighting device can thus be rapidly located on the body of a follow spotlight and the standard, sighting arm, and sight reticles adjusted to align respective apertures of the reticles with the beam of light, the couplings allowing free movement of the several structural elements during adjustment and further acting to positively maintain alignment of the elements once adjusted.

18 Claims, 5 Drawing Figures

FOLLOW SPOT SIGHTING DEVICE

BACKGROUND OF THE INVENTION

1. Field of the Invention

The invention relates generally to sighting devices and particularly to a sighting device for a follow spotlight. The present device provides a coupling structure which allows ready adjustment of the sighting device to an aligned condition, the coupling frictionally retaining alignment of the elements of the device.

2. Description of the Prior Art

In a theatrical setting, lighting is indispensible both to the setting of a mood and to the focusing of attention on desired subjects. Stage lighting and lighting utilized in performances other than in a stage setting invariably include one or more follow spotlights which particularly act to focus attention on an object, event or performer. While the follow spotlight is primarily intended to capture the eye of the observer, the follow spot can also be used unobtrusively to subtly provide fill and accent on a virtually subconscious level. Proper operation of a follow spot adds immeasurably to a theatrical performance. However, the mood of a performance and indeed the very professionalism of the performers can suffer substantially when the operator of the follow spot fails to accurately and timely make the "pickups" necessary to maintenance of the flow and pace of the performance.

Traditionally, follow spot operators have primarily relied upon hand-eye coordination to aim the follow spot at a point where a pickup is to be made. In order for even an experienced operator to pick up a performer exactly on cue without having to center the light after light activation, it is necessary that the operator be familiar with the lamp, the performance itself, and the house in which the performance occurs, the distance from the light booth or light location to the stage and the angle of throw of the light beam being important. Since follow spot operators working in the modern performing arts world are required to work in a number of different theatrical situations including the traditional stage as well as in arenas and the like in which a variety of spotlights are in use, it is not realistically possible for an operator to rely upon simple coordination to accurately hit even the relatively simple spots. In the more traditional stage situation where the lamp and the operator are located in a light booth, it is possible to mark the wall of the light booth with cue locations which align with a pinpoint of light which escapes from the top of the lamp housing in certain lamp models. This prior alignment method can be used only in situations where the operator is working in a light booth and has the time to mark the wall of the light booth with chalk symbols which correspond with various pickup points on the stage. In situations where the follow spot operator is unable to utilize such a method either due to time restrictions or physical restrictions imposed by the nature of the house itself or the lamp, the operator has previously relied on hand-eye coordination to operate the spot. Even when such a technique can be used, it is necessary for the operator to continually take his eye off of the stage in order to locate the marks with the inconvenience and risk attendant to this redirection of the operator's attention. The present invention finds solution to the problems inherent in the prior art by providing a sighting device which, when attached to the barrel of the lamp, allows the lamp to be correctly positioned prior to a pickup so that an accurately centered spot appears exactly on cue.

SUMMARY OF THE INVENTION

The invention provides a sighting device which is particularly useful in the correct positioning of a follow spotlight in a theatrical setting. Lack of familiarity with either the lamp itself, the house or arena, or the production being performed as well as lack of preparation time renders difficult the reliance on hand-eye coordination to make accurate pickups in many present day use environments, the spot operator having only a minimum of time for preparation of the lamp prior to a performance. Since this preparation must include cleaning and maintenance of the lamp, placement of particular color filters in the color-frame holders, and checking of the freeswing travel of the lamp, it is apparent that little time remains for referencing the beam of light to points on the stage or the referencing of the lamp to marks in the light booth if the lamp is operated within such a booth. Accordingly, the present sighting device provides an invaluable aid to the follow spot operator in situations where preparation time is minimal. Further, use of the present sighting device negatives the need for the relatively complex system of stage or light booth reference points.

During a performance, the follow spot operator is in constant communication with a stage manager or a lighting director via a two-way communication system. The operator is cued verbally over the communication system as to the subject, subject location, light color, etc. for the spot. On cue, the subject is picked up and followed for a desired time interval. As the warning cue is given, the operator places in position the color frame indicated, swings the lamp into the position necessary to make the pickup, opens the iris diaphragm to the size necessary to properly cover the performer, and, on cue, opens the dowser to hit the subject with light. As the operator is following the performer with the light, critical adjustments in the focus and size of the spotlight is made as the performer moves relative to the stage apron. The full process from presetting the follow spot to going out on exit is repeated for each cue throughout the performance. Cues range from simple stationary pickups to blacking out on one performer and picking up a second performer already on the stage and in motion. Such pickups can become even more difficult if the size of the spot is to be a small head-spot or pin-spot. The present sighting device allows the follow spot operator to correctly position the lamp prior to a pickup regardless of the degree of difficulty of the pickup. The operator can properly align the lamp with a performer by visually sighting through the present sighting device, the sighting device having been preset to align with the center of the beam of light which is thrown on the stage. Once the lamp is aligned with the performer through the sighting device, the operator need not be hesitant to open the dowser on cue since the light will appear exactly on the performer without the need for additional centering. Accordingly, the operator can concentrate on following the performer as soon as the light is activated. Use of the present sighting device allows an operator to make smooth and effortless pickups and to avoid throwing the light on the stage in the wrong place and at the wrong time, thereby drawing attention to the light and detracting from the performance.

The accuracy of the present sighting device remains constant with respect to the beam of light once the device is set. The present sighting device is referenced to the beam rather than to the stage or to the lighting booth, a change in position of the lamp thus having no affect on the accuracy of the sighting system. A sighting system using reference marks on the stage or in the light booth is, of course, destroyed on movement of the lamp from a position referenced relative to marks on the stage or in the light booth. Further, mounting of the sighting device directly on the barrel of the follow spot allows the operator to bring the sight into the field of vision with only minimal head movements, thereby avoiding the constant searching for reference marks in the light booth or otherwise which is necessary with prior sighting systems. Since the operator need not continually adjust his vision from bright stage to dark booth, the need for retinal adjustment from light to dark is avoided through use of the present sighting device.

By preferably providing a magnetic mounting base for the sighting device, the device can be mounted to the barrel of the follow spot in any position which is convenient depending upon the height of the operator. Taller operators who hunch over a lamp are able to mount the sighting device directly on the top of the barrel while shorter operators place the sighting device on the side of the barrel. In all situations, the sighting device can be placed out of the way of other control handles so that the device will not be accidentally moved during operation of the follow spot. In the event that the sight is accidentally moved after sighting alignment of the sight, the operator can realign the device with the light beam as the lamp is being operated and without the need for the eyes of the operator to leave the stage.

Structurally, the present sighting device includes a sighting arm having sight reticles disposed at each end of the arm, the sight reticles being independently movable in respective planes which are perpendicular to the longitudinal axis of the sighting arm. The sight reticles are held on the arm by retentive couplings which allow ready rotation of the reticles with a minimum application of force, but which hold the reticles in place when external force is not applied to the reticles. The sighting arm is mounted medially of its length to the distal end of an L-shaped standard by a cruciform coupling which allows both rotation of the arm about the coupling and linear displacement of the arm relative thereto. The sighting arm can thus be rotated in a plane essentially perpendicular to the longitudinal axis of the distal leg of the standard. The standard itself is mounted to a base member, the standard being rotatable about the longitudinal axis of the anterior leg thereof to allow full articulation of the device in any desired degree of freedom. The base member preferably includes a magnetic lower surface which allows the sighting device to be removably mounted directly to the barrel of the lamp. The sighting device can thus be rapidly located on a barrel of the follow spotlight and the standard, sighting arm, and sight reticles adjusted to align apertures of the reticles with the beam of light, couplings used to mount the sighting arm to the standard and the reticles to the sighting arm allowing free movement of the several structural elements during adjustment and further acting to positively hold alignment of the elements once adjusted. The sight reticles can be aligned with each other and centered relative to the beam of light by movement of the standard, sighting arm and sight reticles through the degrees of freedom provided by the retentive couplings and the articulation of the several structural elements of the device. Once the two sight reticles are aligned with the center of the beam of light, the operator of the follow spot is able to visually align the reticles with the performer or object which is to be picked up and be assured that the pickup will perfectly occur when the lamp is activated.

Accordingly, it is an object of the present invention to provide a sighting device for a follow spotlight which enables an operator to visually sight the lamp on a performer or object which is to be picked up prior to activation of the lamp.

It is another object of the invention to provide a follow spot sighting device having sight reticles which can be aligned with the beam of light through articulation of structural elements of the device, the device further being removably mountable to the barrel of a lamp in order to allow the beam of light to be referenced directly to the sight carried on the lamp rather than to stage landmarks or light booth reference marks external of the lamp.

It is a further object of the invention to provide a follow spot sighting device having structural elements alignable with the beam of light to facilitate the pickup of performers and objects in a theatrical setting, the sighting device being readily adjustable to align sight reticles of the device with the beam of light, the device including retentive coupling members which allow ready adjustment of the said structural elements on application of minimal force, but which retain the elements in place once adjusted.

Further objects and advantages of the invention will become more readily apparent in light of the following detailed description of the preferred embodiments.

DESCRIPTION OF THE PREFERRED EMBODIMENTS

Figure 1:
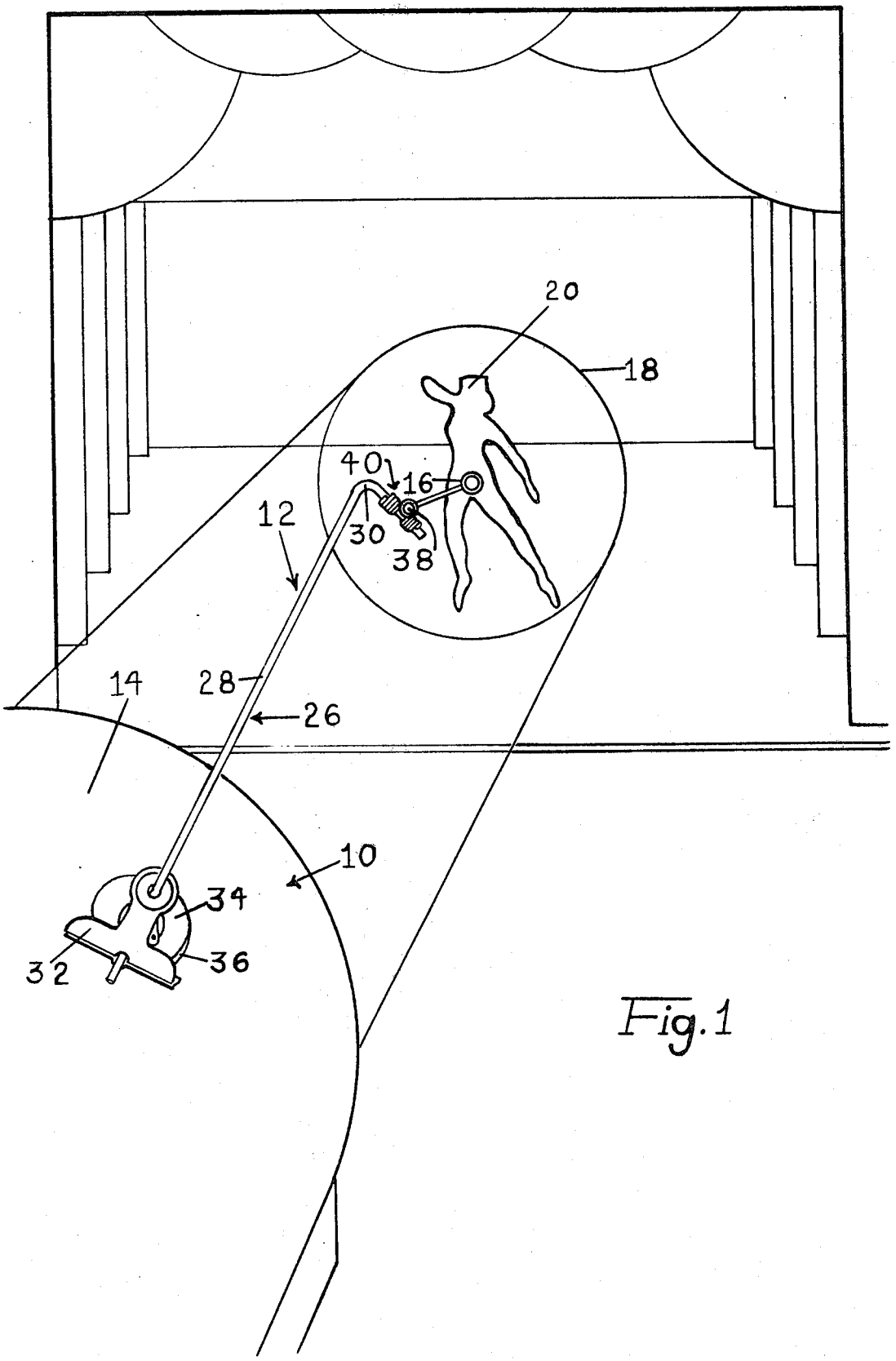
FIG. 1 is a perspective view of the present sighting device mounted to the barrel of a follow spotlight, the spotlight being seen in a use environment.
Figure 2:
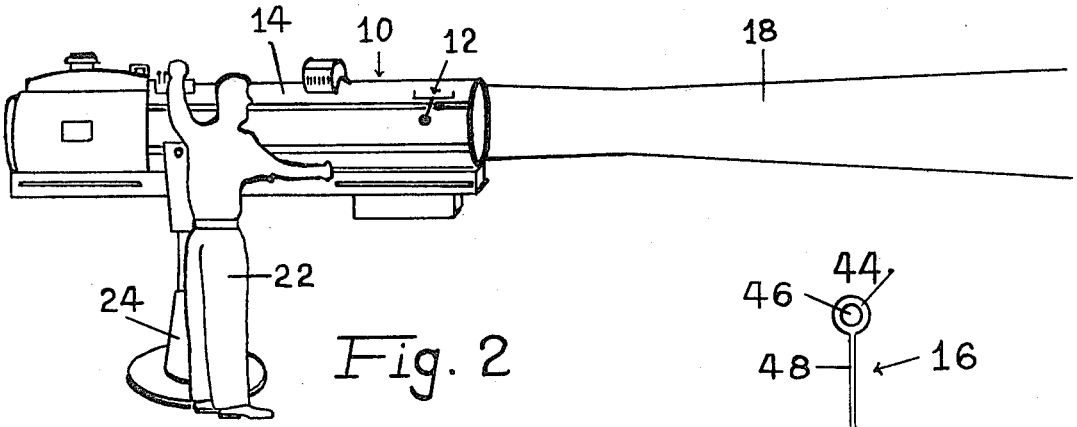
FIG. 2 is a perspective view of a follow spotlight having the present sighting device mounted thereto.

Referring particularly to FIGS. 1 and 2, a follow spotlight 10 is seen in a typical use environment. In a situation shown in FIG. 1, the spotlight 10 is shown as being used in a theatrical environment wherein performers are highlighted by the spotlight on a stage. In such situations, the spotlight 10 is located in a lighting booth (details not shown) which is typically located at the rear of the theater and above the audience and stage. As particularly seen in FIG. 1, the present sighting device is seen at 12 to be located on barrel 14 of the follow spotlight 10, the sighting device 12 having sight reticles 16 which are aligned with the center of the beam of light 18. When the two sight reticles 16 are aligned and centered on a performer 20, the beam of light 18 accurately and correctly picks up the performer on activation of the spotlight 10. It is to be understood that only one of the sight reticles 16 is seen in FIG. 1 since the two reticles 16 are exactly aligned in this drawing.

As seen in FIG. 2, an operator 22 typically stands beside the follow spotlight 10 and operates the various controls which activate/inactivate the beam of light 18, select the proper filter for coloring the beam of light, and vary the iris diaphragm to control the size of the beam of light which is thrown onto the stage. While performing these tasks, the operator 22 must also manually "aim" the barrel 14 of the spotlight both to initially pick up a performer and to follow the performer during the period when attention is to be directed to that particular performer. The barrel 14 is pivotally mounted relative to base 24 in order to provide the necessary freedom of motion. Pickup of a performer on the stage must be accomplished as described above prior to actual activation of the spotlight 10, that is, the performer must be centered in the beam of light 18 at the instant of light activation. The spotlight 10 must thus be properly aligned with the performer prior to opening of the dowser (not shown) which throws the beam of light onto the stage. Reliance on hand-eye coordination, while effective in many instances, is primarily a matter of guess work which depends on the experience of the operator. Lack of familiarity with the particular spotlight 10, the house, and the particular performance can lessen the effectiveness of even the most experienced operator, particularly when the more difficult pickups are required according to the nature of the performance.

Use of the sighting device 12 removes the guesswork from operation of a follow spotlight 10, the operator 22 being able by virtue of his position next to the spotlight 10 to sight through the device 12 and properly align the barrel 14 before light activation and thereby consistently assure a perfect pickup.

The follow spotlight 10 shown particularly in FIG. 2 typically utilizes a carbon arc to produce the beam of light 18. Such spotlights are commercially available from a number of manufacturers including the Strong Electric Corporation of Toledo, Ohio, which manufacturer produces a carbon arc follow spotlight designated by the trademark Super Trouper. This manufacturer also produces similar lights marketed as Strong Troupers and Xenon Troupers. Other typical lights include the Berkey Colortran, the Parellipsphere 220 made by Electro Controls, and the Ultra Arc made by Phoebus Manufacturing Company. Other manufacturers include HMI, Altman, Genarco, Kliegel Brothers, and Strand. The various spotlights and lighting equipment produced by these and other manufacturers are readily adapted to use with the present sighting device 12 as will be apparent from the following description.

Figure 4:
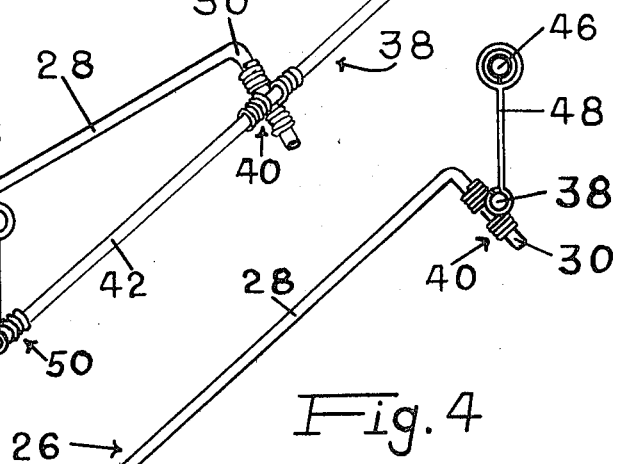
FIG. 4 is an elevational view of the present sighting device.

As is further seen in the drawings, and particularly in FIGS. 1 and 4, the sighting device 12 is comprised of an elongated, L-shaped rod or standard 26, the standard 26 having an elongated shaft portion 28 and a relatively shorter leg 30, the longitudinal axis of the leg 30 being perpendicular to the longitudinal axis of the shaft portion 28. The end of the shaft portion 28 opposite the leg 30 is held by a spring clamp 32, the standard 26 being capable of rotation about the longitudinal axis of the shaft portion 28 while mounted by the spring clamp 32. The clamp 32 is seen to be further mounted by a base 34 having a magnet 36 attached thereto. As can particularly be seen in FIGS. 1 and 2, the sighting device 12 is placed on the barrel 14 of the follow spotlight 10, the magnet 36 and the base 34 causing the sighting device 12 to mount to the barrel 14 in any desired position. While the sighting device 12 could be permanently mounted on the barrel 14, the magnetic mounting provides a desirable degree of flexibility in the location of the sighting device 12 to accommodate differing operator techniques and heights. It should also be understood that the standard 26 can be mounted by structure other than the spring clamp 32 and base 34 combination. While the nature of the mounting structure can vary, it is preferred that the standard 26 be mounted such that said standard is free to rotate about the longitudinal axis of the shaft portion 28 as aforesaid.

Figure 3:
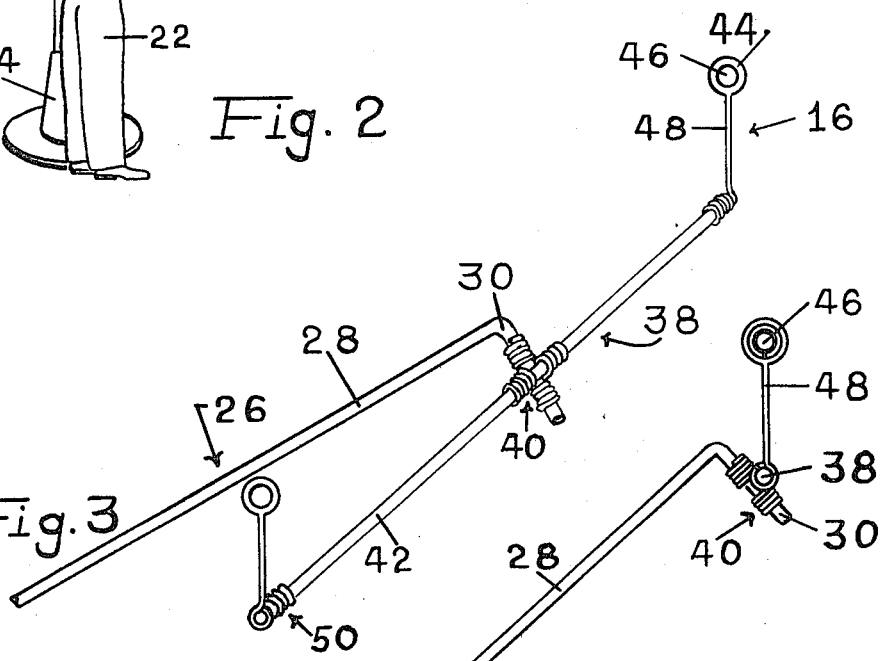
FIG. 3 is a perspective view of a portion of the present sighting device.
Figure 5:
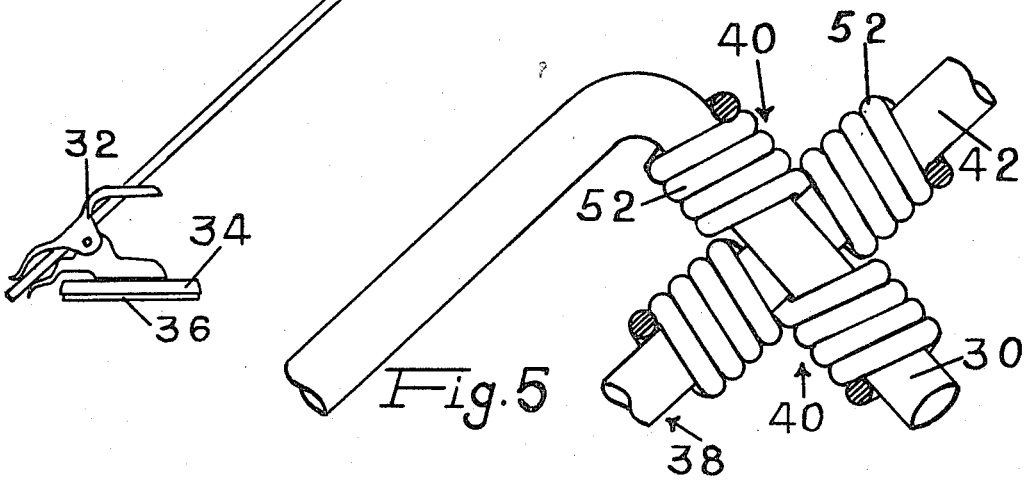
FIG. 5 is a detail plan view of the cruciform retentive coupling which mounts the sighting arm of the present sighting device to the L-shaped standard.

Considering further the structure of the sighting device 12 as is also elucidated in FIGS. 3 and 5, a sighting arm 38 is seen to be mounted to the leg 30 of the standard 26 by means of retentive couplings 40. The sighting arm 38 simply comprises an elongated rod member having the sight reticles 16 disposed at opposite ends thereof. Due to the nature of the retentive couplings 40 which will be described in greater detail hereinafter, the sighting arm 38 is free to rotate in the plane which is perpendicular to the longitudinal axis of the leg 30 and within which the longitudinal axis of the rod member 42 lies. Further, the rod member 42 can be linearly displaced through the retentive couplings 40 to cause greater or lesser portions of the rod member 42 to lie on either side of the couplings 40. One of the sight reticles 16 is disposed at each end of the rod member 42. Each sight reticle comprises an annular ring member 44 which encloses an aperture 46, the ring member 44 being spaced from the respective end of the rod member 42 and mounted thereto by support leg 48. The anterior end of the support leg 48 is preferably formed into a helical coupling 50 which is received on the end of the rod member 42. Due to the nature of the helical coupling 50, the sight reticle 16 can be rotated in the plane within which it lies a full 360°, this plane of rotation being perpendicular to the longitudinal axis of the rod member 42. It is to be understood that the sight reticle 16 can be otherwise mounted to the rod member 42. However, it is preferred that the sight reticle 16 be capable of rotation about the rod member 42. It is preferred that the two respective planes of rotation for the two sighting reticles 16 be disposed in parallel relationship to each other, each sighting reticle 16 being capable of independent rotation within the respective planes of rotation.

The movement afforded to the sight reticles 16 by the various mounting arrangements of the structural elements of the sighting device 12 allows the sighting reticles 16 to be moved as desired in order to align the apertures 46 of the reticles 16 with the beam of light 18 in any manner which would be convenient for the operator 22. As an example, even though the standard 26 is held under tension by the spring clamp 32, the shaft portion 28 is nevertheless free to rotate about its longitudinal axis in order to position the sighting arm 38 in a desired location relative to the field of view of the operator 22. More importantly, once the standard 26 is properly positioned, no further movement of the standard 26 will occur. In a like manner, the sighting arm 38 is capable of three modes of movement. In addition to the full 360° rotation of the sighting arm 38 about the mounting locus to the leg 30 as previously described, the sighting arm 38 is also free to rotate a full 360° about its own longitudinal axis. These movements, coupled with the aforesaid ability of the sighting arm 38 to move linearly along its longitudinal axis, allows the sighting arm 38 to exhibit the necessary degrees of freedom to position the sighting reticles 16 in any manner desired by the operator of the spotlight 10. Considering now the structure of the retentive couplings 40, the couplings 40 can best be seen in FIG. 5 to comprise two separate structural entities. Each of the couplings 40 are formed of drawn wire stock formed into two helical portions 52 which define central channels through which the leg 30 and rod member 42 are flushly received. The longitudinal axes of the helical portions 52 are perpendicular to each other. As best seen in FIG. 5, the innermost winding of each of the helical portions 52 extend over to the other helical portion 52 to form a continuation of the innermost winding of the other helical portion. The retentive couplings 40 thus formed allow full freedom of movement of the sighting arm 38 relative to the standard 26 with a minimum of force being required to move the elements of the sighting device 12 relative to each other. However, the couplings 40 act to hold the structural elements of the sighting device 12 in the selected position when such force is removed. In other words, once the desired position of the sighting arm 38 is selected, the retentive couplings 40 positively hold the sighting arm 38 in the desired position and do not allow "drift" of the sighting arm. It is to be understood that the particular structure of the retentive couplings 40 are preferred but need not be limiting of the scope of the invention. Couplings which allow the desired and necessary freedom of movement of the sighting arm 38 can also be used according to the intent of the invention. The retentive couplings 40, as well as the helical couplings 50 used to mount the sighting reticles 16 to the sighting arm 38 comprise preferred structure for accomplishing the objects of the invention.

Referring particularly to FIGS. 1 and 4, it can be seen that the sighting reticles 16 are exactly aligned relative to each other with the operator 22 sighting through the apertures 46 in the reticles in order to align the spotlight 10 with a performer who is to be picked up by the beam of light. The sight reticles 16 can take a variety of structural conformations as long as the apertures 46 are provided at essentially equal distances from the sighting arm 38. This structural feature is most easily provided by support legs 48 of equal length. As is particularly seen in FIG. 1, alignment of the sight reticles 16 and the centering of this line of sight on the performer 20 causes the beam of light 18 to be perfectly centered on the performer once the sighting device 12 has been properly set relative to the follow spotlight 10. Once the sighting device 12 is set relative to the spotlight 10, the line of sight through the sight reticles 16 will always correspond to the center of the beam of light thrown onto the stage. The sighting device 12 thus enables the operator of the spotlight 10 to accurately aim the beam of light. Once the sighting device 12 is placed on the spotlight 10 and the sight reticles aligned with the beam of light, the operator can preset the spotlight to pick up any person or stage object prior to activation of the beam of light and be assured of a perfect pickup.

It is to be understood that the invention may be practiced other than as explicitly described herein without departing from the intended scope of the invention as defined by the appended claims.

I claim:

1. In combination, a theatrical follow spotlight capable of being directed toward a moving performer or an object in order to throw a beam of light on the moving performer or object and a theatrical follow spotlight sighting device mountable on the spotlight to allow the spotlight to be positioned to controllably throw the beam of light on said moving performer or object, the sighting device comprising:

means for following a performer in motion to enable alignment of the theatrical follow spotlight with the moving performer; and, means for mounting the following means on the spotlight.

2. In the combination of claim 1 wherein the mounting means comprise a magnet for allowing rapid location of the sighting device on a magnetically attractive portion of the spotlight.

3. In the combination of claim 1 wherein the following means comprise:

an elongated L-shaped standard having a shaft portion and a leg portion, the end of the shaft portion opposite the leg portion being held by the mounting means;

a sighting arm mounted to the leg portion of the standard;

coupling means mounting the sighting arm to the leg portion for allowing rotation of the sighting arm in a plane perpendicular to the longitudinal axis of the leg portion, rotation of the sighting arm about its own longitudinal axis, and linear displacement of the sighting arm along its own longitudinal axis;

a sighting reticle having a sighting aperture disposed at and mounted to each end of the sighting arm, the sighting apertures of the sighting reticles being alignable along a line of sight which aligns the spotlight with the object or moving performer; and reticle mounting means for mounting each of the reticles on the sighting arm for rotation in a plane perpendicular to the longitudinal axis of the sighting arm.

4. In the combination of claim 3 wherein the standard is mounted to the mounting means for rotation about the longitudinal axis of the shaft portion of the standard.

5. In the combination of claim 3 wherein the coupling means comprise a pair of coupling members formed of helically wound body portions, the body portions being each formed of at least one length of helically wound wire stock and further being disposed at right angles to each other to respectively receive the leg portion and the sighting arm therethrough, the coupling members being oppositely disposed across the intersection of the leg portion and of the sighting arm.

6. In the combination of claim 3 wherein the sighting reticles are displaced from the sighting arm by support legs which mount the reticles at each end of the arm and helically wind about the sighting arm at the other end of said support legs to form the reticle mounting means.

7. In the combination of claim 3 wherein the mounting means comprise a magnetic base member which allows the sighting device to be removably mounted directly to a magnetically attractive portion of the spotlight.

8. In the combination of claim 1, wherein the following means comprise:

a sighting arm alignable along a line of sight which aligns the spotlight with the object or moving performer; and, means coupling the sighting arm to the mounting means for rotational motion of the sighting arm relative to the mounting means, for rotational motion of the sighting arm about its own longitudinal axis, and for linear displacement of the sighting arm along its own longitudinal axis.

9. In the combination of claim 1, wherein the following means comprise:

a standard mounted to the spotlight;

a sighting arm mounted to the standard;

means mounting the sighting arm to the standard for rotational motion of the sighting arm relative to the standard, for rotational motion of the sighting arm about its own longitudinal axis, and for linear displacement of the sighting arm along its own longitudinal axis;

a sighting reticle having a sighting aperture disposed at and mounted to each end of the sighting arm, the sighting apertures of the sighting reticles being alignable along a line of sight which aligns the spotlight with the object or moving performer; and, reticle mounting means for mounting each of the reticles on the sighting arm for rotation in a plane perpendicular to the longitudinal axis of the sighting arm.

10. In the combination of claim 9, wherein the standard is mounted to the mounting means for rotation about the longitudinal axis of the standard.

11. In the combination of claim 5, wherein the standard is mounted to the mounting means for rotation about the longitudinal axis of the shaft portion of the standard.

12. In the combination of claim 5, wherein the sighting reticles are displaced from the sighting arm by support legs which mount the reticles at each end of the arm and helically wind about the sighting arm at the other end of said support legs to form the reticle mounting means.

13. In the combination of claim 5, wherein the mounting means comprise a magnetic base member which allows the sighting device to be removably mounted directly to a magnetically attractive portion of the spotlight.

14. In combination, a spotlight capable of being directed toward an object in order to throw a beam of light on the object and a sighting device mountable on the spotlight to allow the spotlight to be positioned to throw the beam of light on said object, the sighting device comprising:

means for mounting the sighting device on the spotlight; and means mounted to the spotlight by the mounting means for aligning the spotlight with the object, the aligning means comprising an elongated L-shaped standard having a shaft portion and a leg portion, the end of the shaft portion opposite the leg portion being held by the mounting means, a sighting arm mounted to the leg portion of the standard, coupling means mounting the sighting arm to the leg portion for allowing rotation of the sighting arm in a plane perpendicular to the longitudinal axis of the leg portion, rotation of the sighting arm about its own longitudinal axis, and linear displacement of the sighting arm along its own longitudinal axis, a sighting reticle having a sighting aperture disposed at and mounted to each end of the sighting arm, the sighting apertures of the sighting reticles being alignable along a line of sight which aligns the spotlight with the object, and reticle mounting means for mounting each of the reticles on the sighting arm for rotation in a plane perpendicular to the longitudinal axis of the sighting arm.

15. In the combination of claim 14, wherein the standard is mounted to the mounting means for rotation about the longitudinal axis of the shaft portion of the standard.

16. In the combination of claim 14, wherein the coupling means comprise a pair of coupling members formed of helically wound body portions, the body portions being each formed of at least one length of helically wound wire stock and further being disposed at right angles to each other to respectively receive the leg portion and the sighting arm therethrough, the coupling members being oppositely disposed across the intersection of the leg portion and of the sighting arm.

17. In the combination of claim 14, wherein the sighting reticles are displaced from the sighting arm by support legs which mount the reticles at each end of the arm and helically wind about the sighting arm at the other end of said support legs to form the reticle mounting means.

18. In the combination of claim 14, wherein the mounting means comprise a magnetic base member which allows the sighting device to be removably mounted directly to a magnetically attractive portion of the spotlight.

* * * * *